US006940375B2

(12) United States Patent
Sanada et al.

(10) Patent No.: US 6,940,375 B2
(45) Date of Patent: Sep. 6, 2005

(54) ELECTROMAGNETIC RELAY

(75) Inventors: Hironori Sanada, Tamana (JP); Hiroyasu Tanaka, Yamaga (JP); Hiroaki Yamazaki, Kumamoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/706,313

(22) Filed: Nov. 12, 2003

(65) Prior Publication Data

US 2004/0119566 A1 Jun. 24, 2004

(30) Foreign Application Priority Data

Nov. 12, 2002 (JP) ..... 2002-328089

(51) Int. Cl.[7] ..... H01H 51/22
(52) U.S. Cl. ..... 335/86; 335/83; 335/129
(58) Field of Search ..... 335/78–86, 124, 335/128–131

(56) References Cited

U.S. PATENT DOCUMENTS 5,339,059 A * 8/1994 Kawamura et al. ..... 335/78
6,496,090 B1 * 12/2002 Nishida et al. ..... 335/202

FOREIGN PATENT DOCUMENTS

JP 9-190757 7/1997

OTHER PUBLICATIONS

Patent Abstracts of Japan; Publication No. 09–190757 dated Jul. 22, 1997 (2 pgs).

* cited by examiner

*Primary Examiner*—Lincoln Donovan
(74) *Attorney, Agent, or Firm*—Osha-Liang LLP

(57) ABSTRACT

An electromagnetic relay makes it difficult for deformation due to impact force to easily occur even when bending work is applied to a contact plate. A coil block is put on a base and a moving contact plate and fixed contact plates are so juxtaposed as to oppose one another. The moving contact plate is constituted by a contact-fitting portion to which a moving contact is fixed, a push-in fixing portion which is pushed in and fixed to the base and from which terminal portions extend, and a connection portion for connecting the contact-fitting portion and the push-in fixing portion. The connection portion has a width smaller than those of the contact-fitting portion and the push-in fixing portion. A connection position between the push-in fixing portion and the connection portion is bent and a part of the contact-fitting portion is bent in such a fashion that the positions of the fixed contacts and the positions of the terminal portions are deviated with respect to an implanting direction of the fixed contact plates.

2 Claims, 13 Drawing Sheets

ELECTROMAGNETIC RELAY

BACKGROUND OF THE INVENTION

1. Field of the Invention

This invention relates to an electromagnetic relay.

2. Description of the Related Art

A known electromagnetic relay employs a construction in which a coil block is put on a base, a moving contact plate and fixed contact plates are implanted in such a fashion as to oppose one another, the moving contact plate is allowed to undergo elastic deformation as the coil block is excited and demagnetized, and a moving contact of the moving contact plate is brought into contact with and out of contact from fixed contacts of the fixed contact plates (refer to patent reference 1, for example).

Patent reference 1:
Japanese Patent Laid-open No. 190757/1997

In the electromagnetic relay of the prior art described above, however, a bending work is applied to the moving contact plate to set a reserve load that decides an operating voltage. The bent portion is hardened through work hardening and is likely to undergo deformation when impact force is applied thereto due to fall, etc, so that relay performance greatly changes. It is therefore an object of the invention to provide an electromagnetic relay in which deformation due to impact force does not easily occur even when a bending work is applied to a contact plate.

SUMMARY OF THE INVENTION

To accomplish this object, the invention provides an electromagnetic relay in which a coil block is put on a base, a moving contact plate and fixed contact plates are implanted in such a fashion as to oppose one another, the moving contact plate is allowed to undergo elastic deformation as the coil block is excited and demagnetized, and a moving contact of the moving contact plate is brought into contact with and out of contact from fixed contacts of the fixed contact plates, wherein the moving contact plate comprises a contact-fitting portion to which the moving contact is fixed, a push-in fixing portion which is pushed in and fixed to the base and from which terminal portions extend, and a connection portion for connecting the contact-fitting portion to the push-in fixing portion; the connection portion has a width smaller than the contact-fitting portion and the push-in fixing portion, and a connection position between the push-in fixing portion and the connection portion is bent and a part of the contact-fitting portion is bent in such a fashion that the positions of the moving contact and the terminal portions are deviated with respect to an implanting direction of the moving contact plate.

This construction can secure desired elastic force due to the existence of the connection portion having a small width, and can improve impact resistance by preventing stress concentration while making it possible to set a reserve load due to the bending work at the contact fitting portion.

In this case, it is preferred to form a notch portion along a centerline of the moving contact plate and to adjust an elastic modulus of the moving contact plate by changing the shape of the notch portion.

To accomplish the object described above, the invention provides also an electromagnetic relay in which a coil block is put on a base, a moving contact plate and fixed contact plates are implanted in such a fashion as to oppose one another, the moving contact plate is allowed to undergo elastic deformation as the coil block is excited and demagnetized, and a moving contact of the moving contact plate is brought into contact with and out of contact from fixed contacts of the fixed contact plates, wherein the fixed contact plate comprises a contact-fitting portion to which the fixed contact is fixed, a leg portion from which terminal portions extend, and a connection portion for connecting the contact-fitting portion to the push-in fixing portion; a connection position between the contact-fitting portion and the connection portion and a connection position between the connection portion and the leg portion are bent, respectively, positions of the fixed contacts and the terminal portions are deviated with respect to an implanting direction of the fixed contact plate; and an open portion is formed at the connection position between the contact-fitting portion and the connection portion, and protuberances for reinforcement are formed on both sides of a position corresponding to the open portion.

According to this construction, the existence of the open portion makes it possible to adjust an elastic modulus of the fixed contact plate and to conduct an adjustment work of the moving contact plate by inserting a jig, and the existence of the protuberance for reinforcement makes it possible to acquire desired impact resistance.

BRIEF DESCRIPTION OF THE DRAWING

FIG. 3A(b) is a perspective view of a moving contact plate;

FIG. 3A(c) is a perspective view of a second fixed contact plate;

FIG. 3B(b) is a perspective view of a second fixed contact plate;

DESCRIPTION OF THE PREFERRED EMBODIMENTS

Embodiments of the invention will be hereinafter explained with reference to the accompanying drawings.

Figure 1:
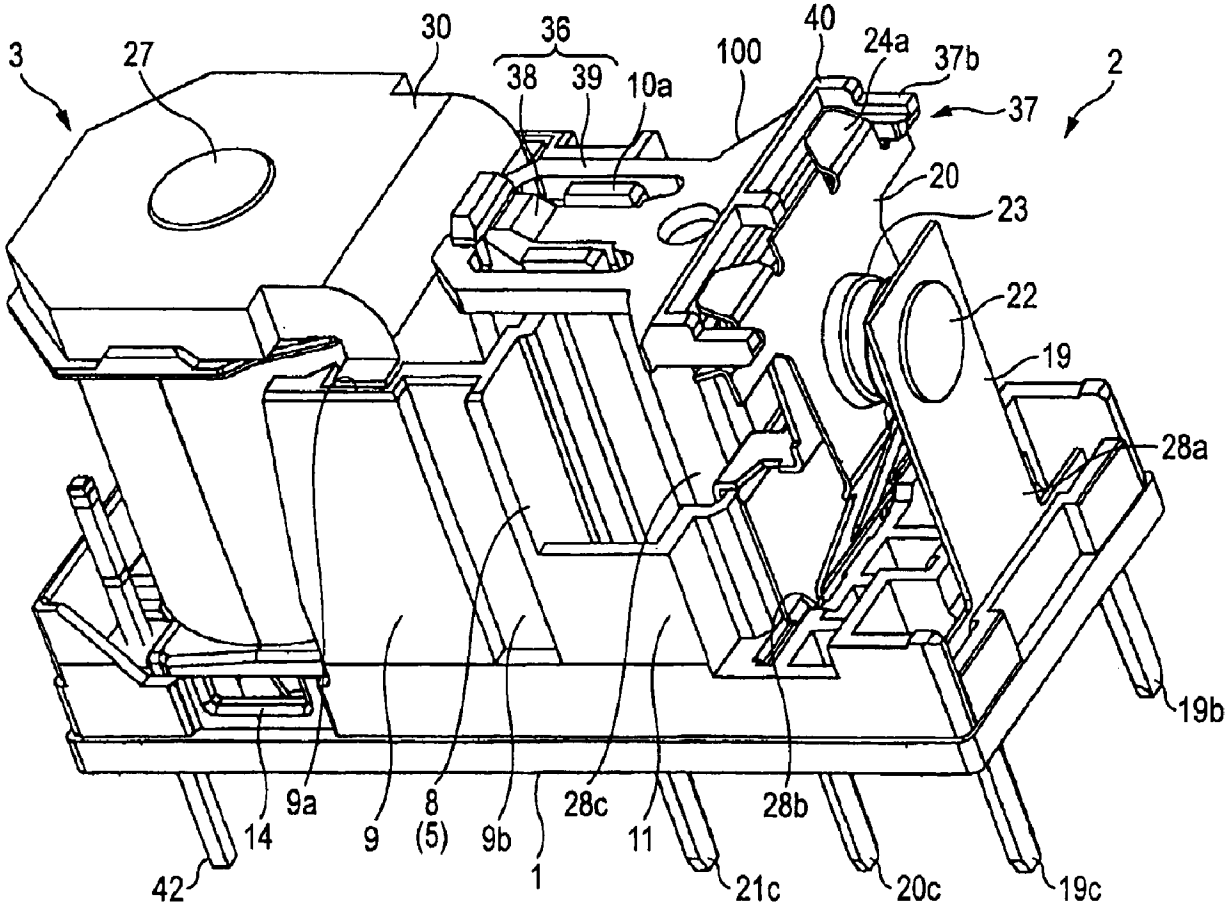
FIG. 1 is a perspective view of an electromagnetic relay according to an embodiment of the invention when its case is removed.
Figure 2:
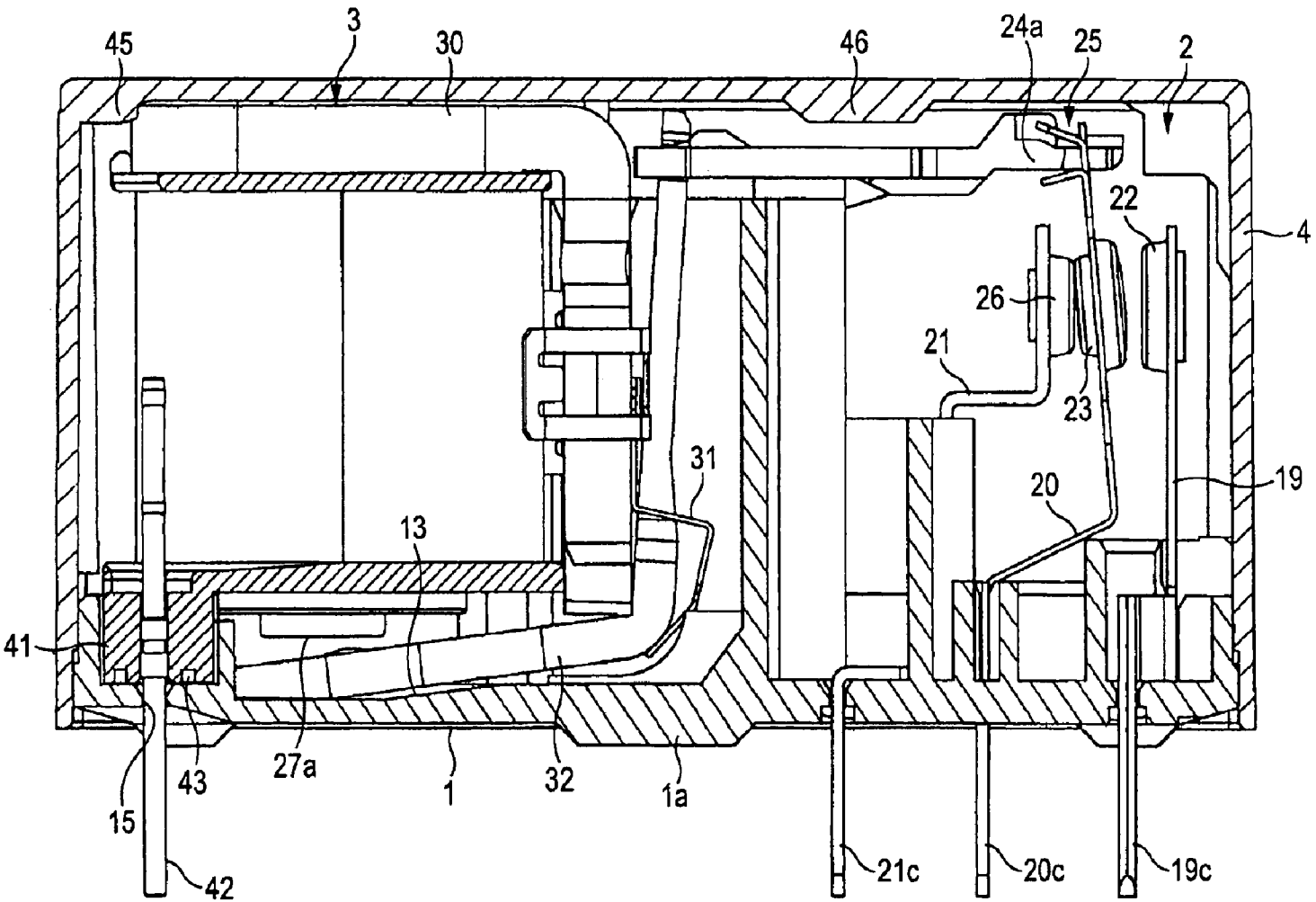
FIG. 2 is a sectional view of the electromagnetic relay according to the embodiment.

FIGS. 1 and 2 show an electromagnetic relay according to an embodiment. The electromagnetic relay briefly has a construction in which a contact switch mechanism 2 and a coil block 3 are arranged on a base 1 and these constituents are covered with a case 4.

Figure 8:
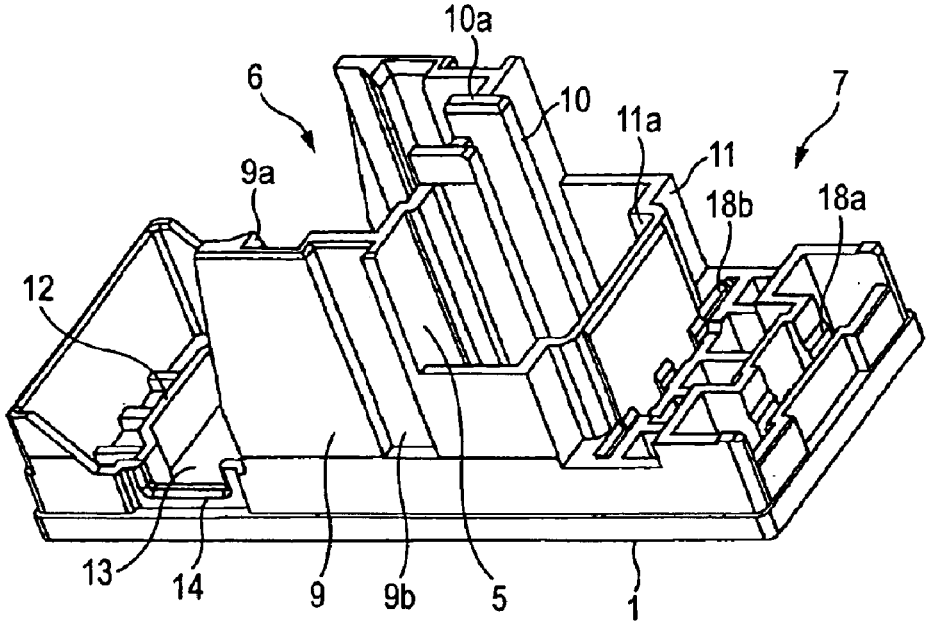
FIG. 8 is a perspective view of a base.
Figure 9:
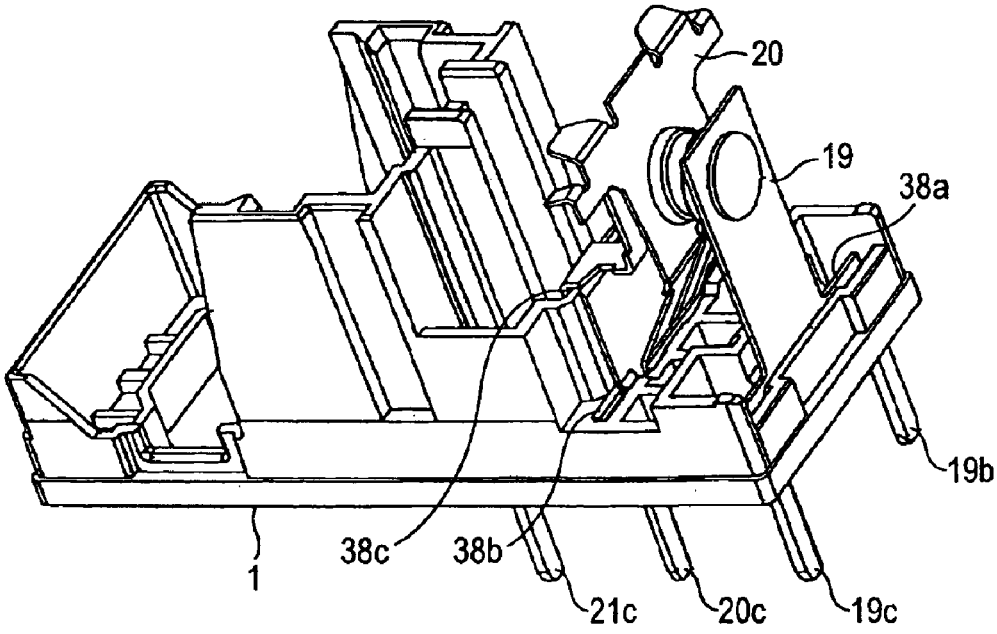
FIG. 9 is a perspective view showing the state where each contact plate is assembled to the base.
Figure 10:
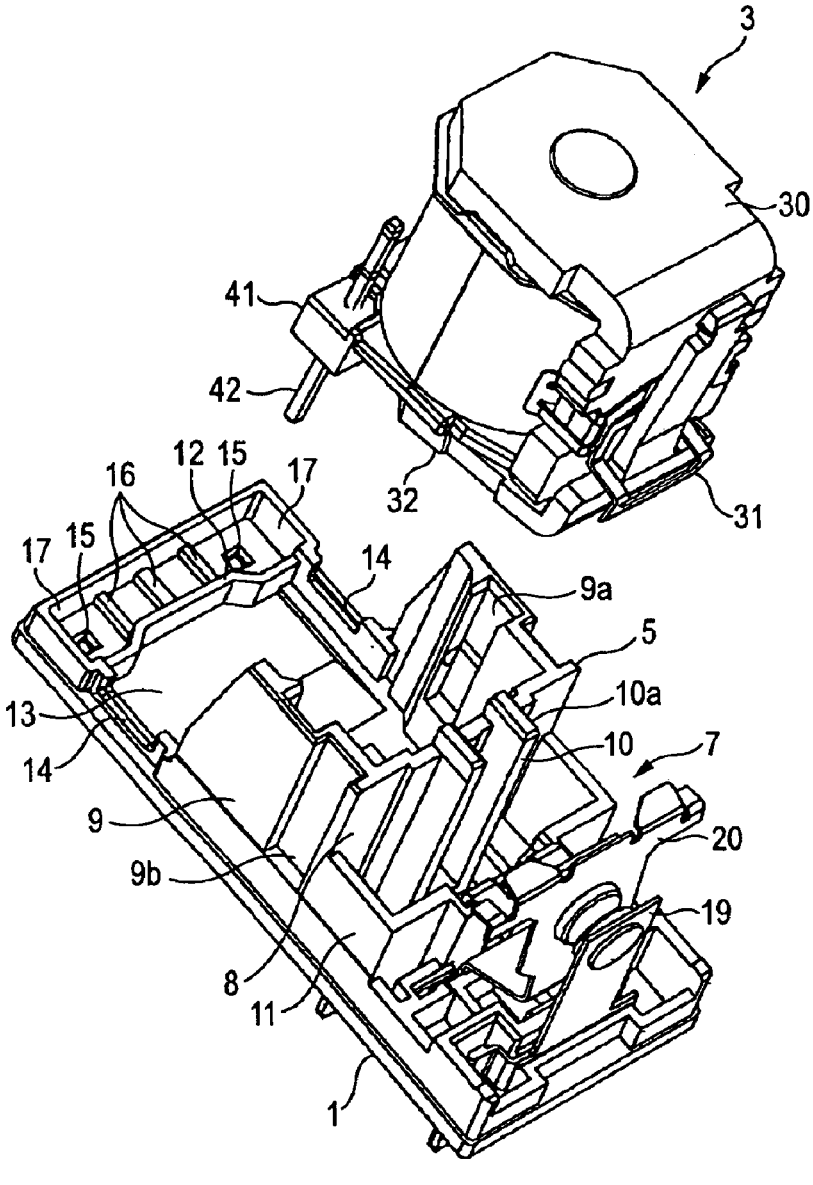
FIG. 10 is a perspective view showing the state before the coil block is assembled to the base to which each contact is assembled.

An insulating wall 5 divides the base 1 into a coil block-fitting portion 6 and a contact switch mechanism-fitting portion 7 as shown in FIGS. 8 to 10.

The insulating wall 5 has a partition portion 8 and both side portions 9. Protuberance portions 10 are so formed at the center of the partition portion 8 as to extend in a vertical direction with a predetermined gap between them. The protuberance portions 10 reinforce the partition portion 8 and guide with their upper edge protuberance portions 10*a* a card 100 that will be later described. An auxiliary insulating wall 11 is formed at a lower part of each protuberance portion 10 in such a fashion as to define a recess in cooperation with the insulating wall 5. A guide groove 11*a* extending in the vertical direction is formed at the center of the inner surface of the auxiliary insulating wall 11. On the other hand, groove portions 9*a* and 9*b* extending in the vertical direction while their positions are deviated from each other are formed on the inner and outer surfaces of both side portions 9, respectively. The inner surface groove portion 9*a* guides a yoke 30 to be later described. The outer surface groove portion 9*b* is a recession for molding the base 1.

As particularly shown in FIG. 10, a partition wall 12 partitions the coil block-fitting portion 6. An escape recess portion 13 is defined in the bottom surface on the side of the insulating wall so partitioned. A notch portion 14 is defined in both sidewalls. Through-holes 15 are defined in the remaining partitioned portions and coil terminals 42 are fitted into both end portions of the through-hole 15. Three base reinforcement ribs 16 defined between both through-holes 15 connect the partition wall 12 to the sidewall on one of the sides. The base reinforcement ribs 16 allow a resin to smoothly fluidize when the base 1 is molded even when the thickness of the bottom surface is small, and also play the role of reinforcement. The partition wall 12 and the base reinforcement ribs 16 together constitute a push-in acceptance portion 17 for pushing and fixing an increased thickness portion 41 of the coil block 3 that will be later described.

Incidentally, reference numeral 1*a* denotes a standoff. The standoff 1*a* forms a clearance with the bottom surface of the base when the electromagnetic relay is mounted to a printed board and eliminates influences of a solder at the time of soldering.

The contact switch mechanism-fitting portion 7 has contact plate push-in portions 18*a*, 18*b* and 18*c* at three positions as shown in FIG. 8.

The contact switch mechanism 2 includes a first fixed contact plate 19, a moving contact plate 20 and a second fixed contact plate 21 that are serially pushed into the contact plate push-in portions 18*a*, 18*b* and 18*c* from one of the ends 18*a* of these contact plate push-in portions 18*a*, 18*b* and 18*c*.

Figure 3A:
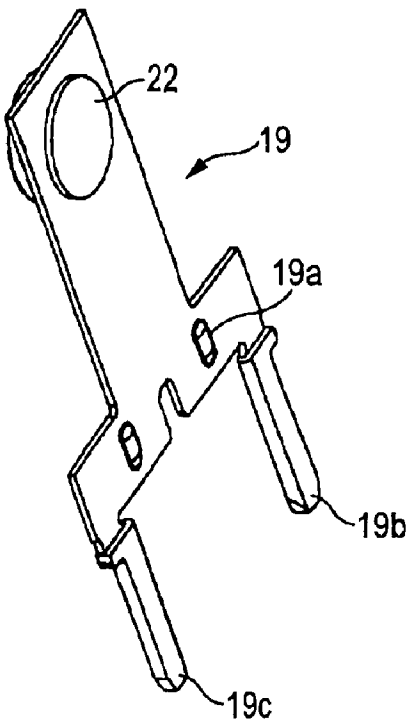
FIG. 3A(a) is a perspective view of a first fixed contact plate.
Figure 3A:
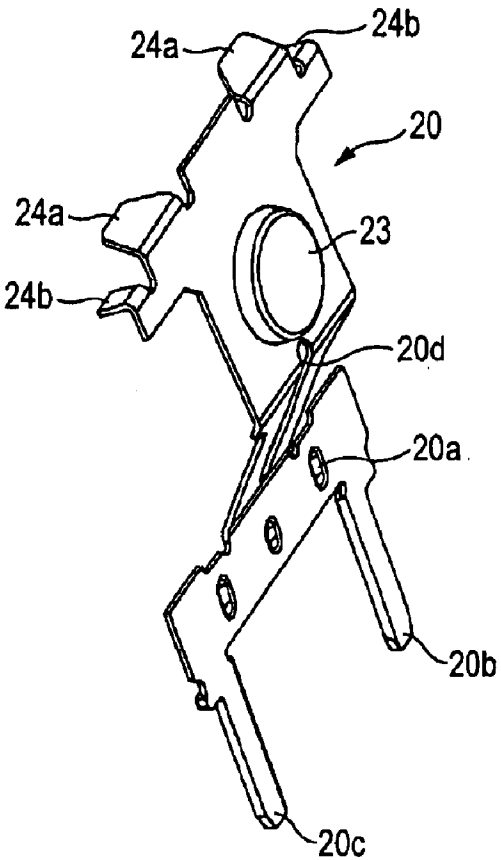
Figure 3A:
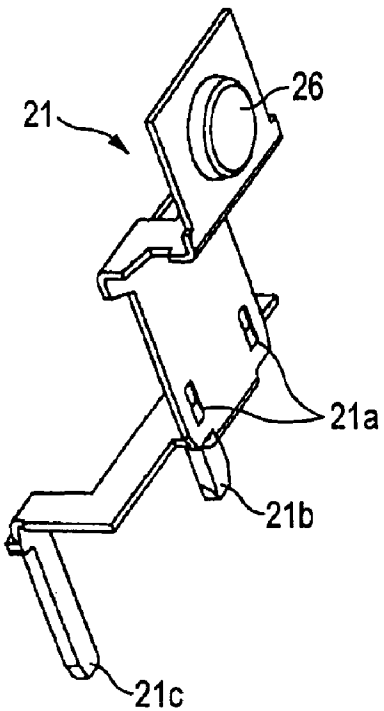
Figure 3B:
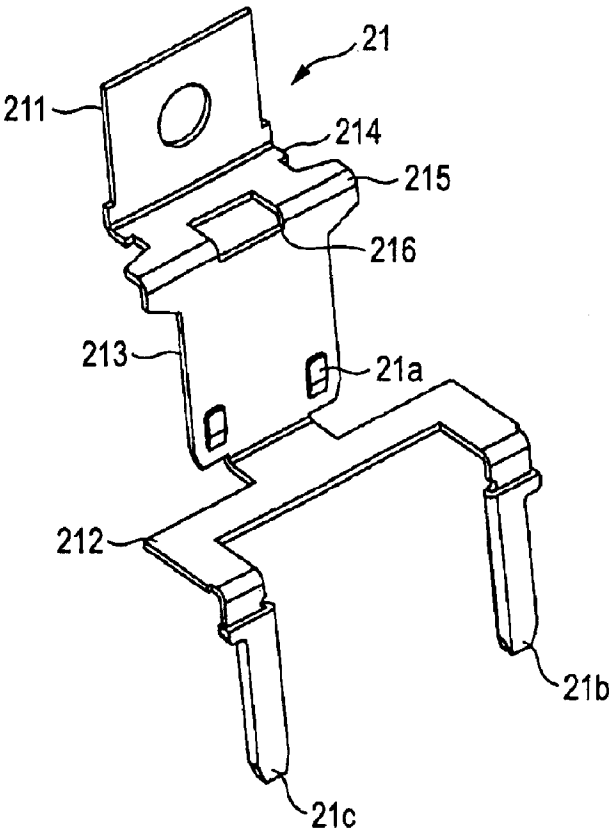
FIG. 3B(a) is a perspective view of a moving contact plate.
Figure 3B:
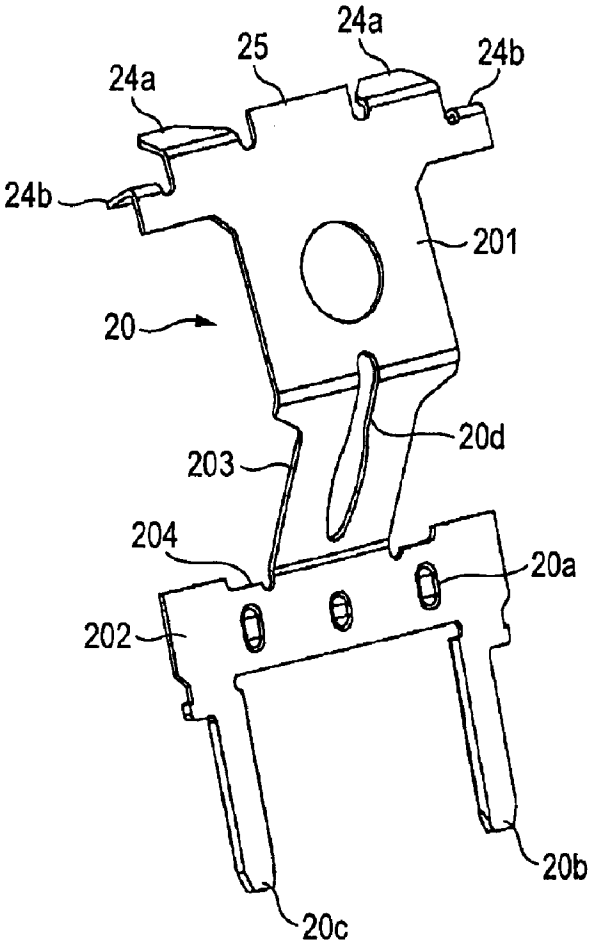

The first fixed contact plate 19 is substantially flat as shown in FIG. 3A(c) and has at its upper end the first fixed contact 22 and at its lower end a protuberance 19*a* to be pushed into the contact plate push-in portion 18. Terminal portions 19*b* and 19*c* extend downward from both sides of the first fixed contact plate 19.

The moving contact plate 20 has a contact-fitting portion 201 to which a moving contact 23 is fixed, a push-in fixing portion 202 which is pushed into and fixed to the base 1 and from which terminal portions 20*b* and 20*c* extend and a connection portion 203 which connects the contact fitting portion 201 and the push-in fixing portion 202 as shown in FIGS. 3A(b) and 3B(a). The moving contact 23 has contact surfaces with fixed contacts 22 and 26 on both of its surfaces. Card acceptance portions 24*a* and 24*b* extending obliquely vertically are formed at the upper edge of the contact-fitting portion 201. A protruding distance of the card acceptance portions 24*a* and 24*b* is set to a value at which the card 100 to be later described does not fall off even when the moving contact plate 20 undergoes elastic deformation. The intermediate part of each card acceptance portion 24*a*, 24*b* constitutes an escape portion 25 lest it becomes an obstacle when the second fixed contact plate 21 is inserted from above. The contact-fitting portion 201 having a greater width than the connection portion 203 is bent at its lower edge. Consequently, the occurrence region of maximum stress when the moving contact plate 20 undergoes elastic deformation is much more dispersed than when the connection portion 203 or the boundary portion with the connection portion 203 is bent, and the contact-fitting portion 201 does not undergo elastic deformation even when impact force operates. Push-in protuberance portions 20*a* are formed in the push-in fixing portion 202 in the same way as the first fixed contact plate 19. Terminal portions 20*b* and 20*c* extend from both sides of the moving contact plate 20. A slit 20*d* is defined at the center of the connection portion 203 so as to allow easy elastic deformation. A boundary portion of the push-in fixing portion 202 with the connection portion 203 is bent and notches 204 are formed on both sides of the bent portion to mitigate stress concentration and to allow the connection portion 203 to easily undergo elastic deformation.

As shown in FIGS. 3A(a) and 3B(b), the second fixed contact plate 21 includes a contact fitting portion 211 to which a fixed contact 26 is fixed, a leg portion 212 which is pushed in and fixed to the base 1 and from which terminal portions 21*b* and 21*c* extend, and a connection portion 213 for connecting the contact fitting portion 211 to the leg portion 212. A first increased width portion 214 is formed at a boundary between the contact fitting portion 211 and the connection portion 213 and the second fixed contact plate 21 is bent substantially at right angles at this first increased width portion 214. A second increased width portion 215 is formed at the upper part of the connection portion 213. The second fixed contact plate 21 is bent substantially at right angles at this second increased width portion 215, too. A rectangular open portion 216 is formed at the center of the second increased width portion 215. The rectangular open portion 216 is disposed so that a jig, or the like, for adjusting spring property of the moving contact plate 20 can be inserted after completion of the assembly of each component to the base 1. Because the increased width portions 214 and 215 exist, the second fixed contact plate 21 does not undergo elastic deformation due to the operation of impact force even when it is bent or when the rectangular open portion 216 is formed. Push-in protuberance portions 21*a* are formed at the lower part of the connection portion 213. The second fixed contact plate 21 is fitted to the base 1 under the state where it is guided by the guide groove 11*a* of the auxiliary insulating wall 11. The auxiliary insulating wall 11 secures desired insulating performance (creep distance) with the moving contact plate 20 when the moving contact 23 is spaced apart from the second fixed contact 26.

Figure 4:
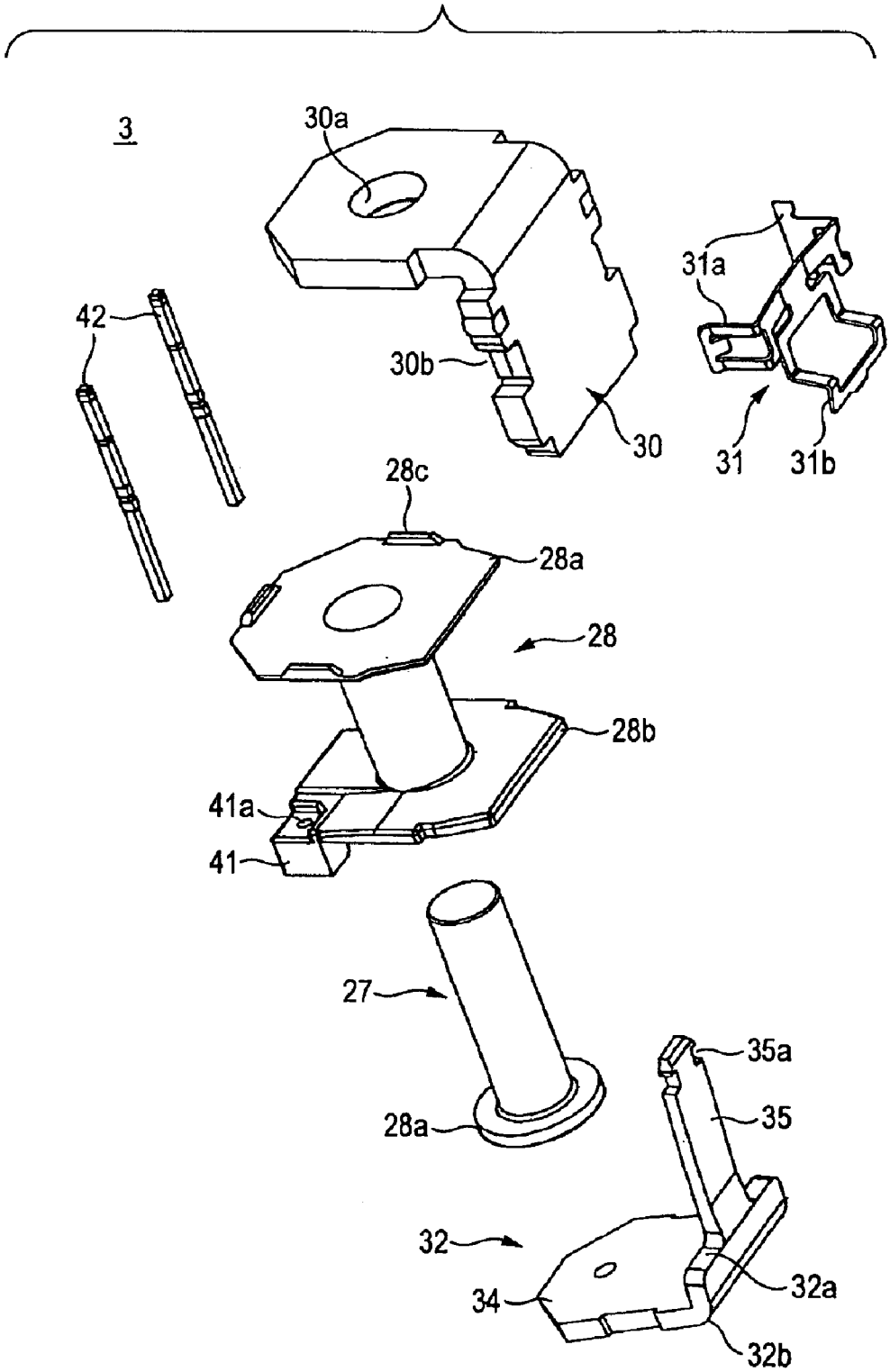
FIG. 4 is an exploded perspective view of a coil block.
Figure 5:
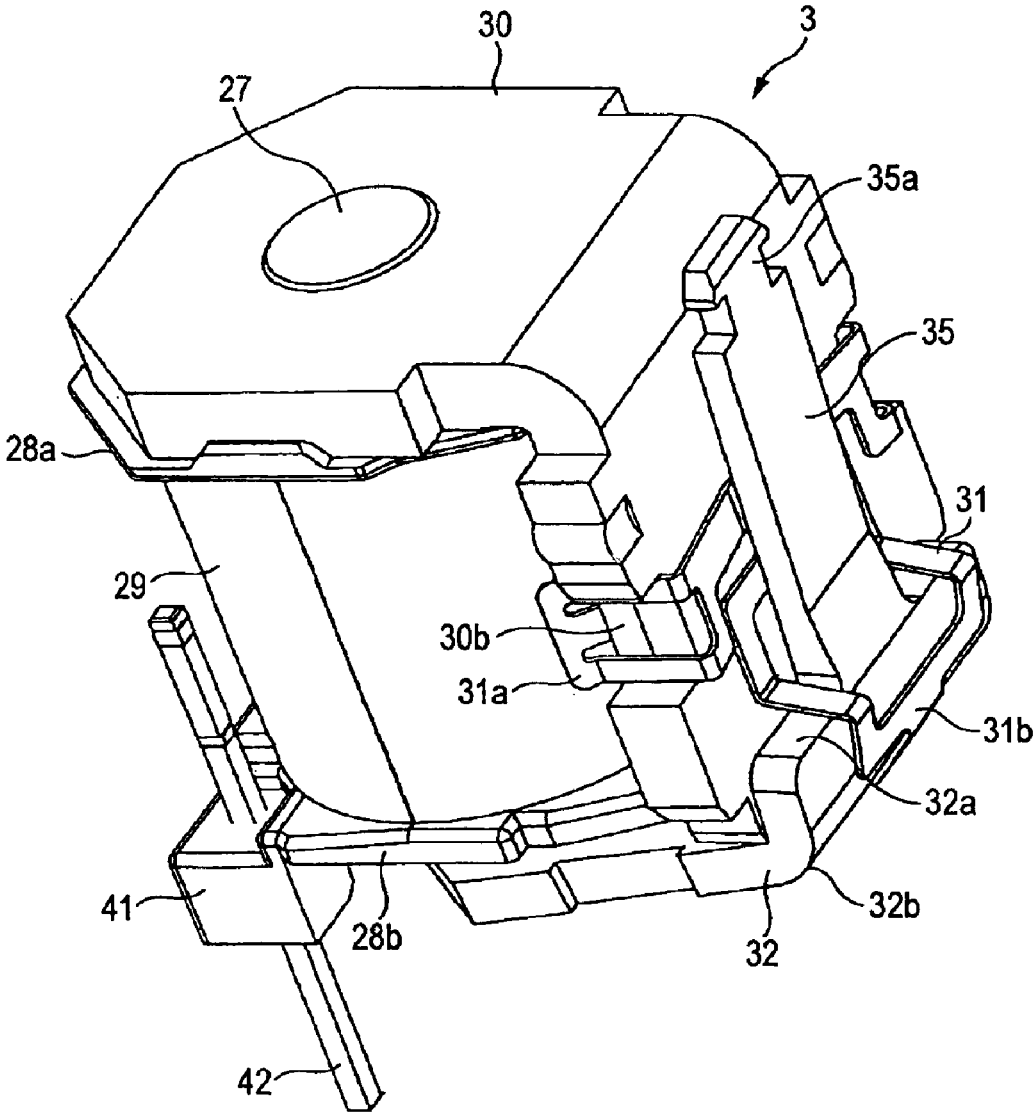
FIG. 5 is a perspective view of the coil block.

The coil block 3 is obtained by winding a coil 29 onto a core 27 through a spool 28 as shown in FIGS. 4 and 5.

A yoke 30 is fixed to the upper end of the core 27. A flange-like lower end of the core 27 operates as an attraction surface 27*a*. The yoke 30 is constituted by a substantially L-shaped magnetic material and has at the center of one of its ends an opening 30*a* into which the core 27 is fitted and fixed. An anchor acceptance portion 30*b* for fitting a hinge spring 31 is formed at a side edge of the other end of the yoke 30. The other end of the yoke 30 operates as a support point for rotation. A substantially L-shaped moving iron plate 32 is supported in such a fashion that a bent portion 33 can freely rock while being held by the hinge spring 31. One of the ends of the moving iron plate 32 is an attracted portion 34 that is attracted to the attraction surface 27*a* of the core 27, and an anchor portion 35*a* is formed at the upper end of a reduced width portion 35 at the other end of the moving iron plate 32. The hinge spring 31 includes an anchor portion 31*a* anchored to the anchor acceptance portion 30*b* of the yoke 30 described above and a rectangular pressure contact portion 31*b* into which the reduced width portion 35 of the moving iron plate 32 is fitted and which comes into pressure contact with the bent portion 33. The rectangular pressure contact portion 31*b* comes into pressure contact with a step portion 32*a* and a curved surface 32*b* of the bent portion 33 of the moving iron plate 32 and urges the moving iron plate 32 counter-clockwise in FIG. 2, that is, in a direction in which the attracted portion 34*b* comes away from the attraction surface 27*a* of the core 27.

Figure 7:
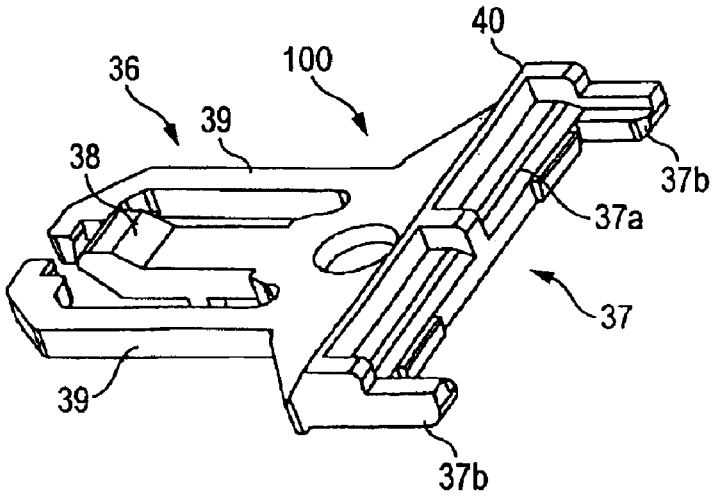
FIG. 7 is a perspective view of a card.

The card 100 is interposed between the anchor portion 35*a* of the moving iron plate 32 and the card acceptance portion 24 of the moving contact plate 20. As shown in FIG. 7, the card 100 has at one of its ends an anchor holding portion 36 to which the anchor portion 35*a* of the moving iron plate 32 is anchored and at its other end a push portion 37 into which the card acceptance portion 24 is pushed. The anchor holding portion 36 has a contact plate 38 that comes into contact with the anchor portion 35*a* of the moving iron plate 32, and a flexible holding plate 39 that flexibly holds the anchor portion 35*a* from both sides. A clearance is defined between the contact plate 38 and the flexible holding plate 39. When the upper end protuberance portion 10*a* formed on the insulating wall 5 of the base 1 is positioned, the card 100 is guided during its horizontal movement. The push-in portion 37 has a reduced thickness portion 37*a* and guide plates 37*b* and 37*b* that are positioned on both sides of the reduced thickness portion 37*a* and are supported by the card acceptance portions 24*b* on the lower side. The distal end of the reduced thickness portion 37*a* is preferably shaped into a taper surface or a curve surface so that the reduced thickness portion 37*a* can come into surface contact with the card acceptance portions 24*a* and 24*b* of the moving contact plate 20. A card reinforcement rib 40 having a substantial E shape when viewed on a plane reinforces the reduced thickness portion 37*a*. Upper and lower card acceptance portions 24*a* and 24*b* of the moving contact plate 20 come into contact with the upper and lower surface edge portions of the reduced thickness portion 37*a*, respectively. The card reinforcement rib 40 not only reinforces the reduced thickness portion 37*a* but also allows a resin to smoothly flow when the card 100 is molded and prevents the occurrence of problems such as short shot. The guide plates 37*b* and 37*b* guide from both sides the card acceptance portion 24*a* on the upper side.

Figure 6:
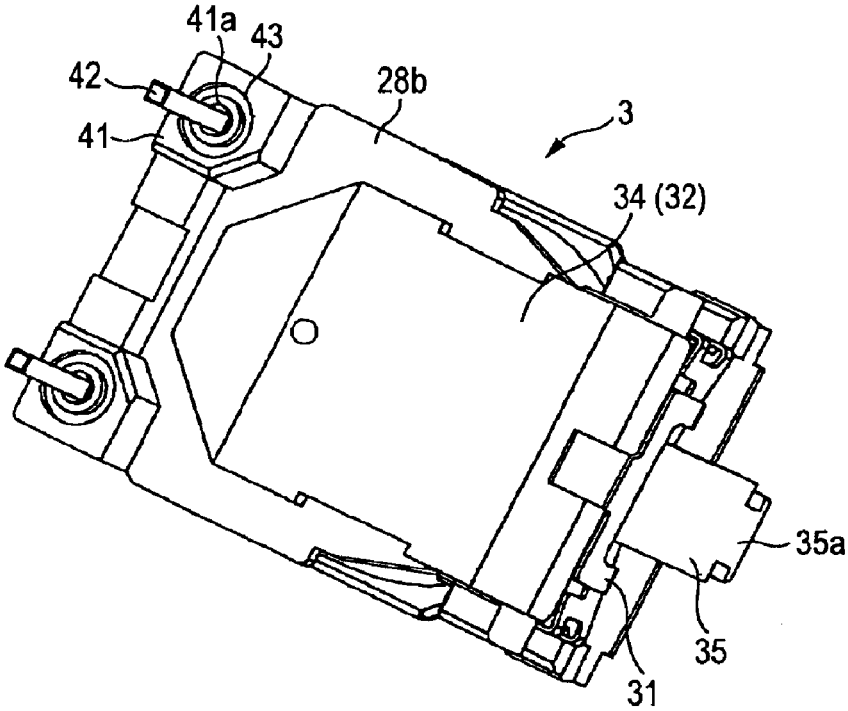
FIG. 6 is a perspective view of the coil block when it is viewed from a bottom side.

As shown in FIGS. 4 and 6, the spool 28 has a cylindrical shape and the core 27 is inserted through the spool 28. The spool 28 has flanges 28*a* and 28*b* at its both ends. Protuberances 28*c* are formed at three positions of the upper flange 28*a* and guide the yoke 30. Increased thickness portions 41 are formed on both sides of the lower flange 28*b*. Each increased thickness portion 41 has a terminal hole 41*a* into which the coil terminal 42 is pushed. A ring-like recess 43 is formed around the terminal hole 41*a* on the bottom surface side. Each increased thickness portion 41 is pushed into each push-in acceptance portion 17 of the base 1 when the coil block 3 is fitted to the base 1, stores a sealant flowing from the through-hole 15 in its ring-like recess 43 and prevents further inflow.

The coil 29 is wound on a drum portion of the spool 28 and both of its ends are wound on the coil terminal 42, respectively.

Figure 13:
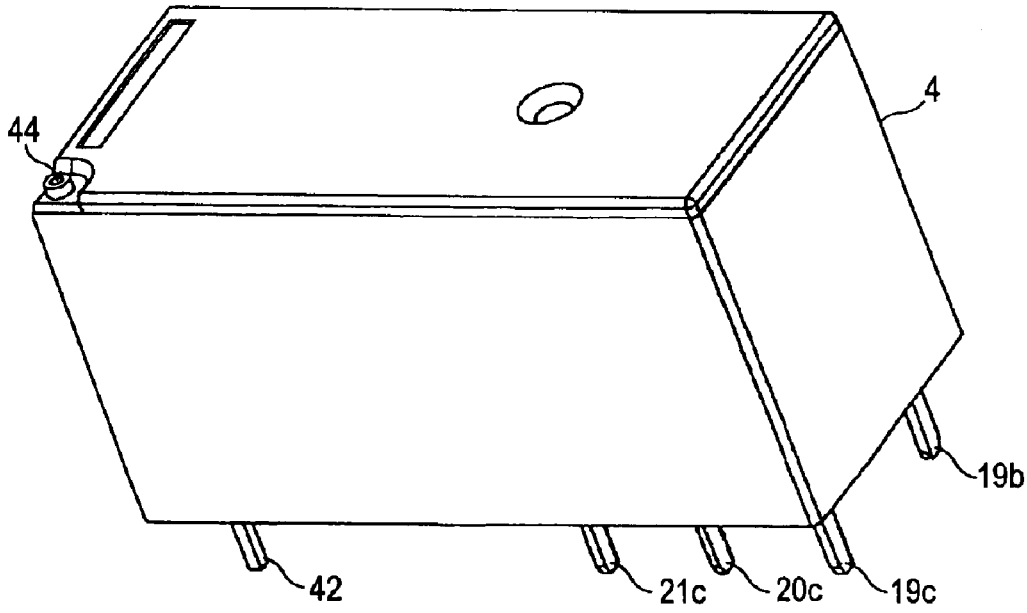
FIG. 13 is a perspective view of an electromagnetic relay.

Referring to FIG. 13, the case 4 has substantially a box shape the lower surface of which is open. When the open edge of the lower surface of the case 4 is fitted to the side surfaces of the base 1, the case 4 covers constituent components. A gas vent hole 44 is formed at a corner of the upper surface to emit the gas resulting from the seal work to the outside. The gas vent hole 44 is thermally sealed when the electromagnetic relay is completed. First and second protuberance portions 45 and 46 protruding inward are formed at a corner and a center portion of the ceiling surface of the base 1 as shown in FIG. 2, respectively. The first protuberance portion 45 guides the yoke 30 and the second protuberance portion 46 restricts the moving range of the card 100.

An assembling method of the electromagnetic relay described above will be subsequently explained.

The coil block 3 is formed in a separate step. In other words, the coil 29 is wound on the core 27 through the spool 28 as shown in FIG. 4 and both ends of the coil 29 are wound on the coil terminals 42 pushed into and fixed to the increased thickness portion 41, respectively. One of the ends of the yoke 30 is fixed to the upper end of the core 27 and the moving iron plate 32 is arranged at the other end of the yoke 30 in such a fashion as to be capable of rocking. The moving iron plate 32 is fitted to the yoke 30 through the hinge spring 31 and is urged to come away from the attraction surface 27*a* of the core 27. The coil block 3 shown in FIG. 5 is thus completed.

Figure 11:
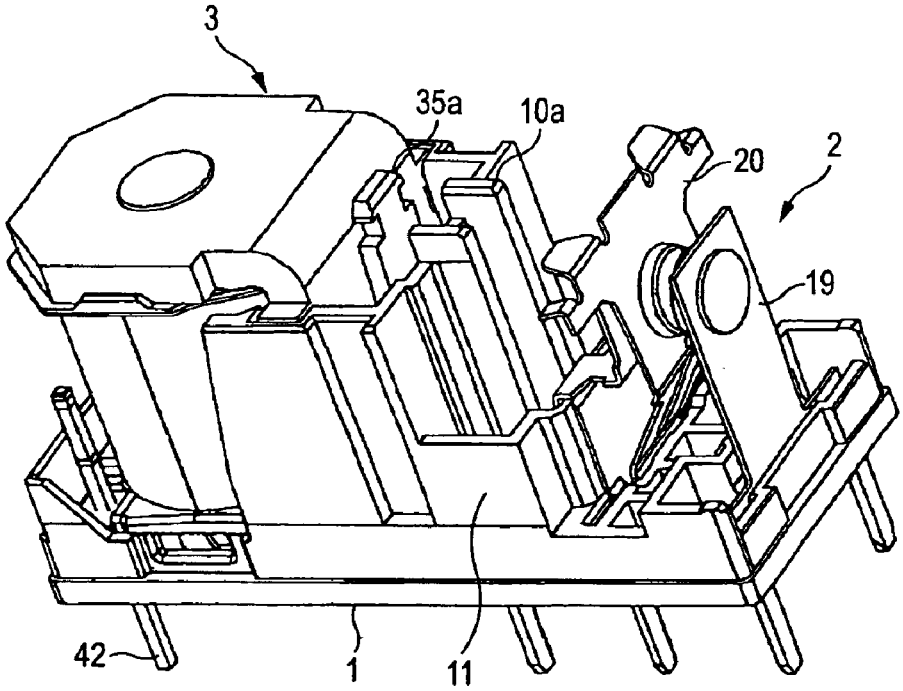
FIG. 11 is a perspective view showing the state where each contact plate and the coil block a reassembled to the base.

The moving contact plate 20 and the first and second fixed contact plates 19 and 21 are pushed into and fixed to the base 1 as shown in FIG. 9 and the completed coil block 3 is assembled to the base 1 as shown in FIGS. 10 and 11. The coil block 3 is fixed as the increased thickness portion 41 is pushed into the push-in acceptance portion 17 and both side portions 9 of the yoke 30 are pushed into the inner surface groove portion 9*a*. A space is defined under this state between the base 1 and the coil block 3 and a rotation space of the moving iron plate 32 can be secured. However, the escape recess 13 formed in the base 1 restricts the height of the electromagnetic relay. Each contact plate is pushed into and fixed to the base 1 in the sequence of the first fixed contact plate 19, the moving contact plate 20 and the second fixed contact plate 21. When the second fixed contact plate 21 is first pushed in, its bent portion prevents the push-in operation of the moving contact plate 20. Therefore, the moving contact plate 20 is first pushed in and then the second fixed contact plate 21 is pushed in and fixed. In this case, the escape portion 25 prevents the interference of the second fixed contact 26 though the card acceptance portion 24 is formed at the upper end of the moving contact plate 20.

Figure 12:
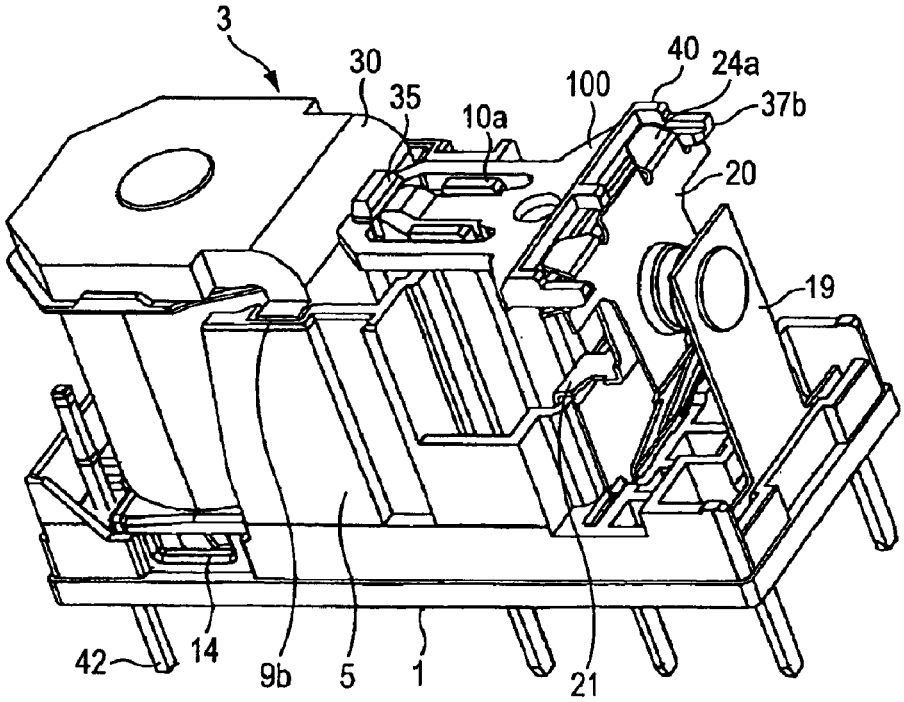
FIG. 12 is a perspective view showing the state where each contact plate and the coil block are assembled to the base and the card is fitted.
Figure 14:
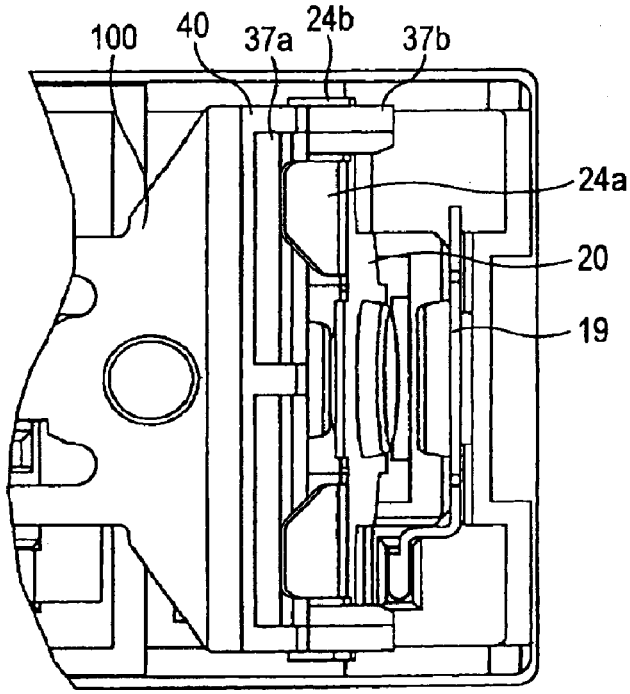
FIG. 14 is a partial plan view showing a contact switch mechanism.
Figure 15:
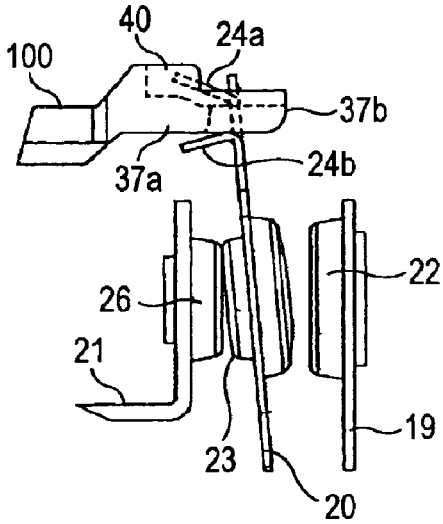
FIG. 15 is a partial front view showing the contact switch mechanism.

After the push-in and fixing operation of the coil block 3 and each contact plate 19, 20, 21 to the base 1 is completed, the anchor holding portion 36 of the card 100 is anchored to the anchor portion 35*a* of the moving iron plate 32 as shown in FIG. 12. In other words, when the anchor holding portion 36 is pushed from the side of the anchor portion 35*a*, the flexible holding plate 39 undergoes elastic deformation and then returns to its original shape. In consequence, the flexible holding plate 39 and the contact plate 38 hold the anchor portion 35*a*. After the moving contact plate 20 is allowed to undergo elastic deformation and then to return to its original shape, the reduced thickness portion 37*a* of the card 100 is positioned between the upper and lower card acceptance portions 24 formed at the upper end of the moving contact plate 20. As shown in FIGS. 14 and 15, the card acceptance portions 24 prevent fall-off of the card 100 in the vertical direction and the guide plate 37*b* formed on the card 100 prevents a positioning error of the card 100 in the transverse direction.

After fitting of the card 100 is completed, power is applied to the coil 29 through the coil terminals 42 and the coil block 3 is magnetized and demagnetized to thereby rotate the moving iron plate 32. Whether or not the moving iron plate 32 is appropriately attracted to the attraction surface 27*a* of the core 27 is confirmed with eye or by use of laser through the notch portion 14 formed in the base 1. Whether or not switching of the contacts is appropriately conducted is also confirmed at this time to inspect the absence/existence of an operation defect. When any operation defect exists, the shape of the moving contact plate 20 is deformed for adjustment, for example.

When the operation is satisfactory, the case 4 is fitted to the base 1 as shown in FIG. 13 to cover the constituent components. The base 1 is turned upside down so that its bottom surface faces upward, and the terminal holes and the fitting portion between the base 1 and the case 4, and so forth, are sealed with the sealant by use of a nozzle, or the like. The sealant enters the inside due to capillary. The sealant entering from the clearance between each terminal portion 19*b*, 19*c*, 20*b*, 20*c*, 21*b*, 21*c* of each contact plate 19, 20, 21 and the terminal hole is far from the region in which the contacts are opened and closed, and improves the fixing strength of the contact plates to the base 1. The sealant entering from the clearance between the coil terminal 42 and the through-hole 15 is stored in the ring-like recess 43 formed in the increased thickness portion 41 of the coil block 3 and its further invasion is checked. Even when the sealant enters beyond the ring-like recess portion 43, the partition wall 12 prevents the sealant from reaching the driving region of the moving iron plate 32. Therefore, even when the driving region of the moving iron plate 32 is positioned in the proximity of the region that the sealant enters, the problem due to adhesion, etc does not occur.

The electromagnetic relay is completed in the manner described above. However, the gas vent hole 44 formed in the case 4 may well be used while left open or under the sealed state after it is thermally sealed depending on the environment of use. Even when impact force acts on the internal constituent components due to fall, or the like, no problem occurs because each component is firmly fixed to the base 1. The card 100, in particular, has the simple construction in which the moving iron plate 32 and the moving contact plate 20 are merely interconnected. One of the ends of the card is interconnected to the moving iron plate 32 through the anchor holding portion 36 and the other end guides the reduced thickness portion 37*a* of the push-in portion 37 within the range in which the moving contact plate 20 can undergo deformation. The upper end protuberance portion 10*a* formed on the insulating wall 5 of the base 1 is positioned between the contact plate 38 and the flexible holding plate 39 constituting the anchor holding portion 36 and the second protuberance portion 46 formed on the case 4 is positioned above the card 100. Therefore, even when any impact force operates, the card 100 does not fall off.

Next, the operation of the electromagnetic relay described above will be explained.

While power is not applied to the coil 29 and the coil block 3 is demagnetized, the moving iron plate 32 rotates counter-clockwise in FIG. 2 due to the urging force of the hinge spring 31 with the rotation support point at the distal end of the yoke 30 being the center. In consequence, the moving contact plate 20 is under the erected state due to its own flexible force and keeps the moving contact 23 under the closed state relative to the second fixed contact 26.

When power is applied to the coil 29 and the coil block 3 is excited, one of the ends of the moving iron plate 32 is attracted to the attraction surface 27*a* of the core 27 and the moving iron plate 32 rotates clockwise in FIG. 2 with the rotation support point at the distal end of the yoke 30 being the center. In consequence, the card 100 moves to the right and the moving contact plate 20 undergoes elastic deformation. In this case, since the distal end of the reduced thickness portion 37*a* of the card 100 pushes the card acceptance portion 24 of the moving contact plate 20, contact becomes line contact or surface contact and wear dust does not develop. Movement of the card 100 closes the moving contact 23 relative to the first fixed contact 22 and the contact is thus switched.

Figure 16:
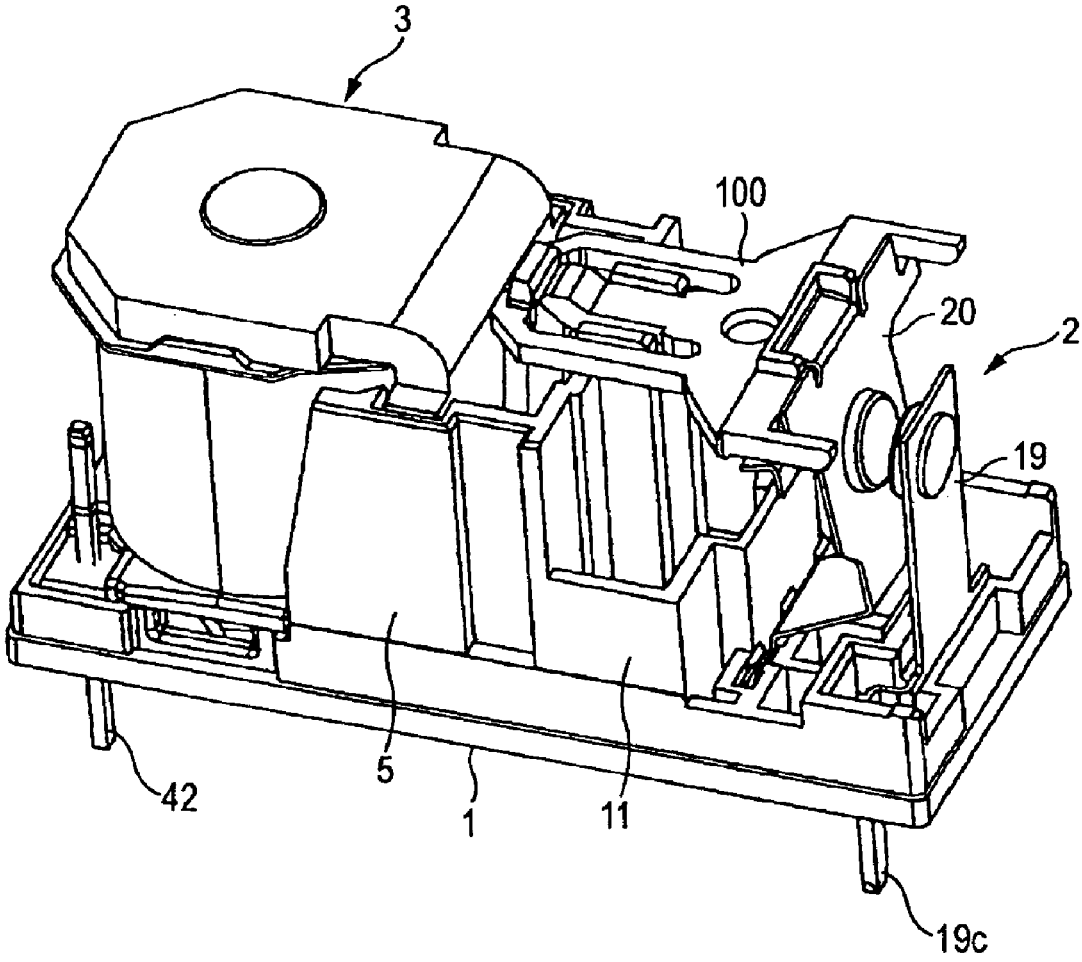
FIG. 16 is a perspective view of an electromagnetic relay according to another embodiment.

In the embodiment described above, the fixed contact plates 19 and 20 are disposed on both sides of the moving contact plate 20, but they may be disposed on only one side. In other words, it is possible to employ a construction in which only the second fixed contact plate 21 is not disposed but the rest of the constituent components are as such used as shown in FIG. 16.

In the embodiment described above, the guide plate 37*b* of the card 100 is disposed separately from the card reinforcement rib 40. However, it is also possible to employ a construction in which the card reinforcement rib 40 operates also as the guide plate 37*b*. In other words, the card reinforcement ribs 40 positioned on both sides guide both side portions 9 of the upper card acceptance portion 24. At least one each card acceptance portion 24 of the moving contact plate 20 may well exist at the upper and lower positions. In the construction in which the second fixed contact plate 21 is not disposed, the card acceptance portion 24 may well be formed at the center.

As is obvious from the explanation given above, the invention bends a part of the contact-fitting portion and deviates the positions of the fixed contacts and the terminal portions with respect to the implanting direction of the fixed contact plates. Therefore, the invention makes it possible to set a reserve load, can secure desired strength for the bent portion and can acquire a construction excellent in impact resistance.

What is claimed is:

1. An electromagnetic relay in which a coil block is put on a base, a moving contact plate and fixed contact plates are implanted in such a fashion as to oppose one another, said moving contact plate is allowed to undergo elastic deformation as said coil block is excited and demagnetized, and a moving contact of said moving contact plate is brought into contact with and out of contact from fixed contacts of said fixed contact plates, wherein:

said fixed contact plate comprises a contact-fitting portion to which said fixed contact is fixed, a leg portion from which terminal portions extend, and a connection portion for connecting said contact-fitting portion to said push-in fixing portion; a connection position between said contact-fitting portion and said connection portion and a connection position between said connection portion and said leg portion are bent, respectively, so that positions of said fixed contacts and said terminal portions are deviated with respect to an implanting direction of said fixed contact plate;

said moving contact plate comprises a contact-fitting portion to which said moving contact is fixed, a push-in fixing portion which is pushed in and fixed to said base and from which terminal portions extend, and a connection portion for connecting said contact-fitting portion to said push-in fixing portion;

said connection portion has a width smaller than said contact-fitting portion and said push-in fixing portion;

a connection position between said push-in fixing portion and said connection portion is bent and a part of said contact-fitting portion is bent in such a fashion that the positions of said moving contact and said terminal portions are deviated with respect to an implanting direction of said moving contact plate; and the bend line of the moving contact plate and the fixed contact plate is perpendicular to the direction of movement of the moving contact plate.

2. An electromagnetic relay according to claim 1, wherein a notch portion is defined along a centerline of said moving contact plate, and an elastic coefficient of said moving contact plate is adjustable when a shape of said notch portion is changed.

* * * * *